US012606336B2

(12) United States Patent
Kurokawa

(10) Patent No.: US 12,606,336 B2
(45) Date of Patent: Apr. 21, 2026

(54) BOXING DEVICE

(71) Applicant: ISHIDA CO., LTD., Kyoto (JP)

(72) Inventor: Masashi Kurokawa, Ritto (JP)

(73) Assignee: ISHIDA CO., LTD., Kyoto (JP)

( * ) Notice: Subject to any disclaimer, the term of this patent is extended or adjusted under 35 U.S.C. 154(b) by 0 days.

(21) Appl. No.: 19/042,978

(22) Filed: Jan. 31, 2025

(65) Prior Publication Data

US 2025/0256878 A1 Aug. 14, 2025

(30) Foreign Application Priority Data

Feb. 13, 2024 (JP) ..... 2024-019275

(51) Int. Cl.

| | |
|---|---|
| ***B65B 43/39*** | (2006.01) |
| ***B65B 5/06*** | (2006.01) |
| ***B65B 5/10*** | (2006.01) |
| ***B65B 43/42*** | (2006.01) |
| ***B65B 43/46*** | (2006.01) |

(Continued)

(52) U.S. Cl.

CPC ..... *B65B 43/39* (2013.01); *B65B 5/06* (2013.01); *B65B 5/106* (2013.01); *B65B 43/42* (2013.01); *B65B 43/46* (2013.01); *B65B 43/54* (2013.01); *B65B 43/59* (2013.01); *B65B 5/061* (2013.01); *B65B 2220/18* (2013.01)

(58) Field of Classification Search

CPC ..... B65B 43/39; B65B 43/46; B65B 43/52; B65B 43/54; B65B 43/58; B65B 43/59; B65B 5/101; B65B 5/105; B65B 5/106; B65B 5/108; B65B 2220/18; B31B 50/784; B31B 50/802

See application file for complete search history.

(56) References Cited

U.S. PATENT DOCUMENTS 3,587,207 A * 6/1971 Shuttleworth ..... B65B 43/39 53/381.1
3,641,735 A 2/1972 Daily et al.
(Continued)

FOREIGN PATENT DOCUMENTS

| | | | |
|---|---|---|---|
| EP | 3 235 742 A2 | 10/2017 | |
| JP | 2014061904 A | 4/2014 | |
| WO | WO-2011119563 A2 * | 9/2011 | ..... B65B 39/007 |

OTHER PUBLICATIONS

Extended European Search Report issued in corresponding European Application No. 25155851.6, dated Jul. 23, 2025, 8 pages.

*Primary Examiner* — Joshua G Kotis
(74) *Attorney, Agent, or Firm* — United IP Counselors, LLC

(57) ABSTRACT

A boxing device has a box-moving section that moves a box with flaps from a supply position to a boxing position; a flap support section; and a pushing section. At the boxing position, articles are boxed in the box's opening. The flap support section supports the flaps. A pushing section pushes a group of side-by-side aligned articles into the box in the boxing position. Before the pushing section pushes the articles into the box, the box-moving section moves the box so that the box changes from a first orientation, in which the opening of the box faces sideways in the box supply position, to a second orientation, in which the opening of the box faces upwards in the boxing position. The flap support section supports the flaps as the box is moved from the first orientation to the second orientation.

6 Claims, 11 Drawing Sheets

(51) Int. Cl.
*B65B 43/54* (2006.01)
*B65B 43/59* (2006.01)

(56) References Cited

U.S. PATENT DOCUMENTS 4,587,792 A 5/1986 Hartness et al.
4,864,801 A * 9/1989 Fallas ..... B65B 39/007 53/448
5,445,590 A * 8/1995 Pazdernik ..... B65B 43/39 493/317
5,855,105 A * 1/1999 Ferris ..... B65B 5/101 53/244
7,096,650 B2 * 8/2006 Van Dam ..... B65B 5/061 53/247
8,689,530 B2 * 4/2014 Prahm ..... B65B 5/106 53/247
2008/0072549 A1 * 3/2008 Vissers ..... B65B 35/38 53/244
2014/0179501 A1 * 6/2014 Akama ..... B31B 50/262 493/162
2015/0087491 A1 * 3/2015 Langen ..... B65B 43/305 493/162
2015/0232217 A1 * 8/2015 Yokota ..... B65B 43/42 414/222.01
2017/0341790 A1 * 11/2017 Yokota ..... B65B 5/108
2019/0071196 A1 3/2019 Watanabe et al.
2019/0375526 A1 * 12/2019 Yokota ..... B65B 65/003
2020/0361650 A1 * 11/2020 Nishitsuji ..... B65B 5/061
2021/0061505 A1 * 3/2021 Yokota ..... B65B 43/42
2023/0226792 A1 * 7/2023 Iwasa ..... B65B 65/02 53/564

* cited by examiner

BOXING DEVICE

TECHNICAL FIELD

This disclosure relates to a boxing device.

BACKGROUND ART

Japanese Laid-open Patent Publication No. 2014-61904 describes a boxing device in which articles are boxed from the side into a cardboard box laid with an opening facing sideways, and the cardboard box is then rotated 90° and stood up so that the opening faces upwards.

SUMMARY OF THE INVENTION

In a boxing device such as the one disclosed in Japanese Laid-open Patent Publication No. 2014-61904, if articles are boxed after the cardboard box has been placed with the opening facing upwards, flaps of the cardboard box may fall inward. If the articles are boxed with the flaps laying inward, the boxing may not proceed smoothly and the contents may be damaged.

An object of the present disclosure is to provide a boxing device that can prevent box flaps from falling inward.

Thus, an embodiment of a boxing device in accordance with the claimed invention has a box-moving section, a flap support section, and a pushing section. The box-moving section moves a box from a box supply position to a boxing position. The box has flaps. The flaps are disposed continuously with respect to side walls that define an opening. At the box supply position, the box is supplied from the outside. At the boxing position, a plurality of articles are boxed in the opening. The flap support section supports the flaps. A pushing section pushes an article group, in which a plurality of the articles conveyed by an article-conveying section are aligned side-by-side, into the box in the boxing position. The box-moving section, before the pushing section pushes the article group into the box, moves the box so that the box changes in orientation from a first orientation, in which the opening of the box faces sideways in the box supply position, to a second orientation, in which the opening of the box faces upwards in the boxing position. The flap support section supports the flaps when the orientation of the box changes from the first orientation to the second orientation.

In this boxing device, the flaps of the box can be prevented from falling inward.

In a boxing device of a second aspect, the flap support section has a first part, a second part, and a third part. The first part extends along a vertical direction. The second part extends in a direction inclined in relation to the vertical direction. The third part extends along a horizontal direction.

In a boxing device of a third aspect, the box-moving section moves the box from the box supply position to the boxing position while keeping the box aligned with the flap support section.

In a boxing device of a fourth aspect, the pushing section has an opening/closing member. The opening/closing member includes protrusions on a surface that faces the box.

A boxing device of a fifth aspect further has a box-transferring section. The box-transferring section transfers the box in which the article group is boxed. The box-transferring section moves from a standby position to below the box after the box has been changed to the second orientation.

In a boxing device of a sixth aspect, the flap support section lays down a flap that is on a rear side of the box in a box movement direction to the outside of the box when the box moves from the box supply position to the boxing position.

DESCRIPTION OF EMBODIMENTS

Figure 1:
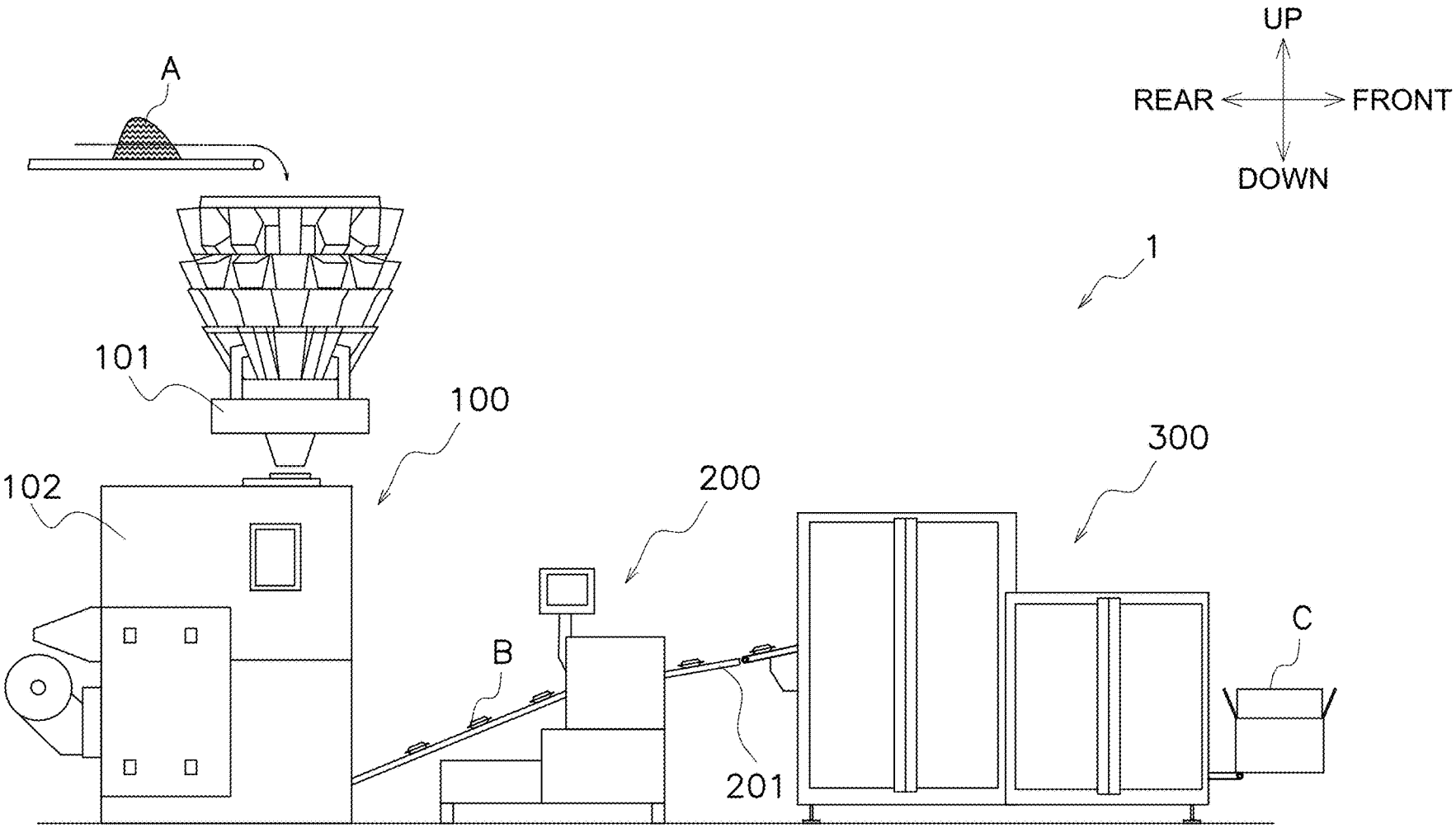
FIG. 1 is a schematic diagram illustrating a packaging and boxing line including an embodiment of a boxing device in accordance with the claimed invention.

Below is a description of an embodiment of a boxing device in accordance with the claimed invention, made with reference to the drawings. In the description of the drawings, the same elements are given the same reference numerals, and redundant description is omitted. In the following description, for convenience, front-rear, up-down, and left-right directions with respect to a boxing device 300 are used. In some drawings, orthogonal axes indicating these directions are displayed. The front-rear and left-right directions are all directions that extend horizontally. The up-down direction is equivalent to a vertical direction. In addition, expressions such as same, horizontal, parallel, etc., may be used; these include not only completely same, horizontal, parallel, etc., but also substantially same, horizontal, parallel, etc.

(1) Overall Configuration

FIG. 1 is a schematic diagram of a packaging and boxing line 1 including the boxing device 300 in accordance with the claimed invention. The packaging and boxing line 1 has a packaging machine 100, an inspection device 200, and the boxing device 300. In FIG. 1, the boxing device 300 is shown as being covered by a cover.

The packaging machine 100 packages a predetermined amount of a product A manufactured by a manufacturing device (not shown) in packaging material. Articles in which product A is packaged in packaging material is hereinafter referred to as articles B. The packaging machine 100 has a combination weighing machine 101 and a bag-making and packaging machine 102. The combination weighing machine 101 is disposed above the bag-making and packaging machine 102. The combination weighing machine 101 weighs the amount of product A that can be contained in one article B, and drops this amount of product into the bag-making and packaging machine 102. The bag-making and packaging machine 102 is a vertical pillow-type bag-making and packaging machine, and packages the product A weighed by the combination weighing machine 101 into articles B (vertical pillow bags) and supplies the articles to the inspection device 200. This example is not provided by way of limitation; the product A may, for example, be a snack food or the like.

The inspection device 200 inspects the articles B supplied from the packaging machine 100 for weight and the presence of pinholes and/or foreign matter, and supplies the articles B to the boxing device 300 via an article-conveying section 201.

Figure 2:
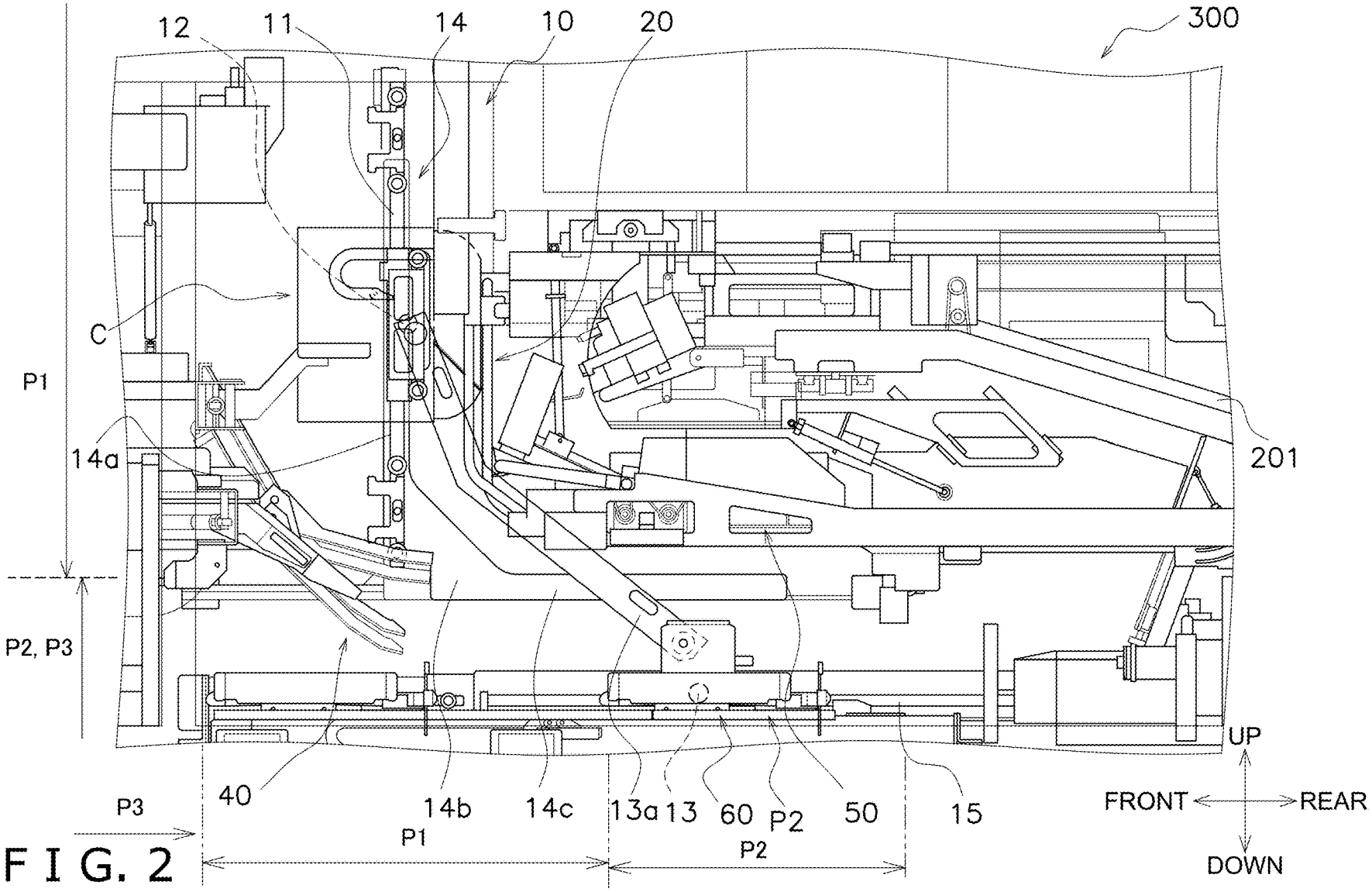
FIG. 2 is a side view of the boxing device shown in FIG. 1.
Figure 4:
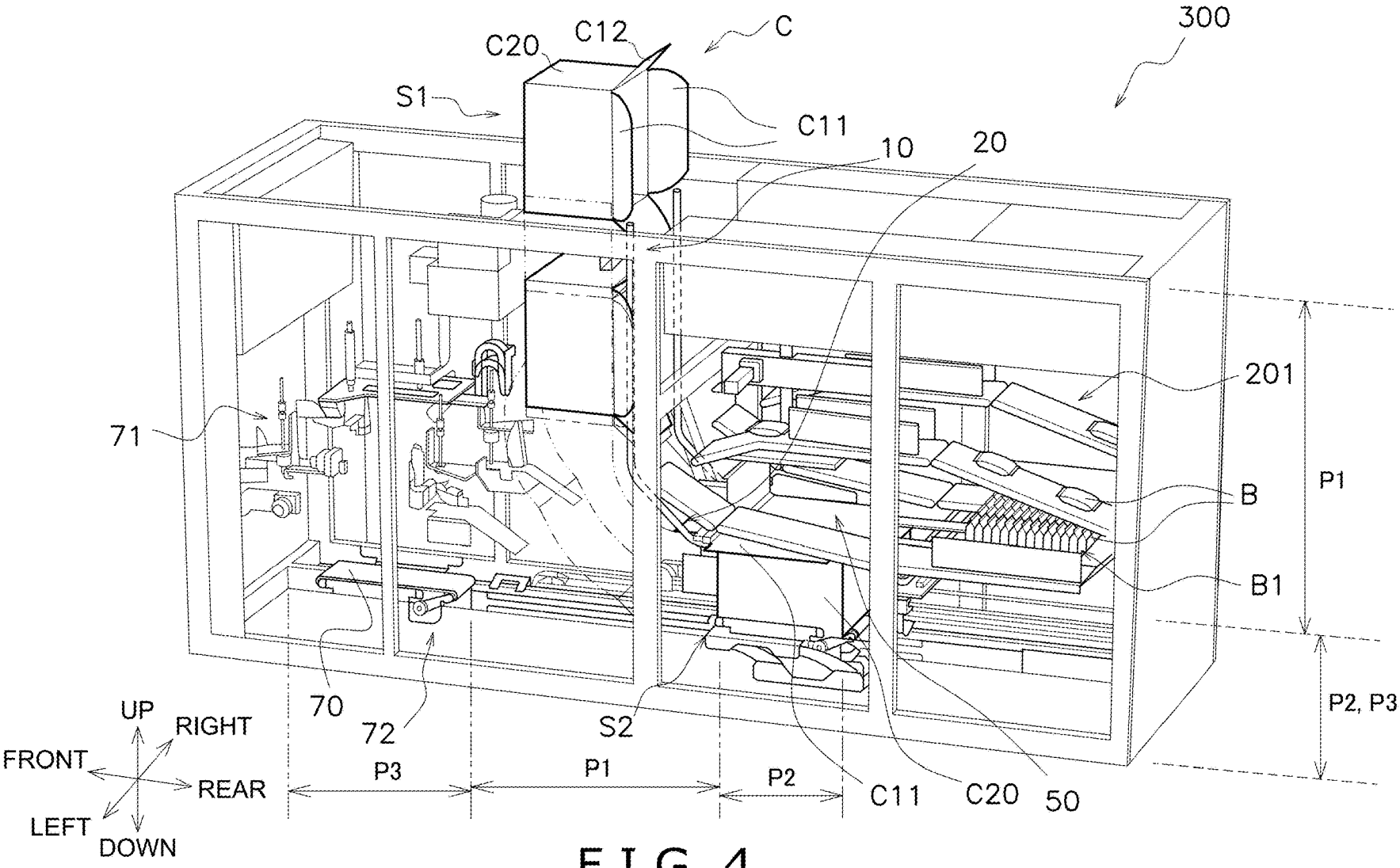
FIG. 4 is a perspective view of the boxing device.

The boxing device 300 combines the articles B supplied from the article-conveying section 201 into an article group B1, and executes a boxing operation of boxing the article group B1 into a box C. As shown in FIG. 2, the boxing device 300 has a box-moving section 10, a flap support section 20, a second flap support section 30 (see FIG. 5), a third flap support section 40, a pushing section 50, a box-transferring section 60, a second box-transferring section 70 (see FIG. 4), and a control unit 80 (see FIG. 9). As shown in FIG. 4, a box supply position P1, a boxing position P2, and a scaling and sorting position P3 are present in the boxing device 300.

Figure 3:
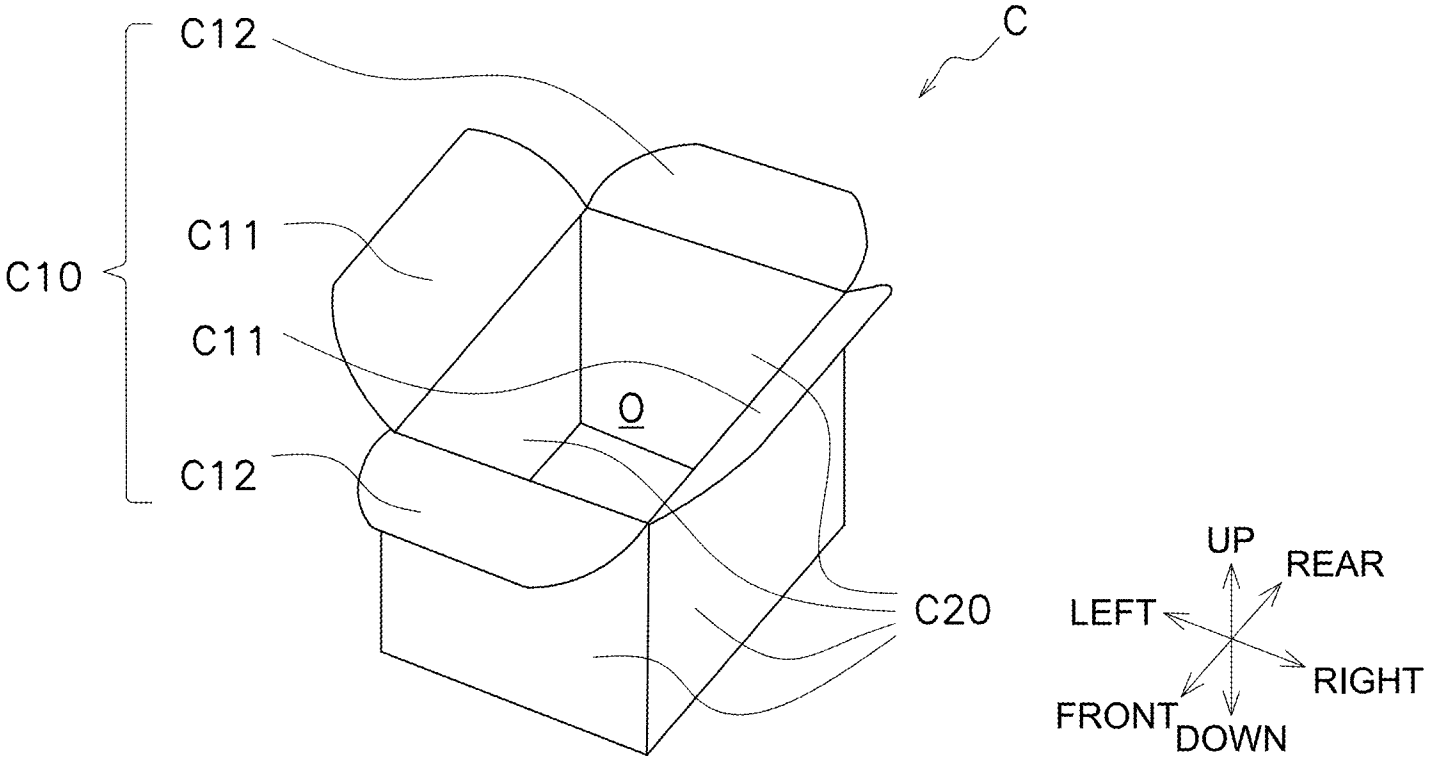
FIG. 3 is a perspective view of a box.

As shown in FIG. 3, the box C has flaps C10 and side walls C20. The side walls C20 define an opening O. The flaps C10 are disposed continuously with respect to side walls C20. In the present embodiment, the flaps C10 include main flaps C11 and minor flaps C12. In the present embodiment, there are two main flaps C11 and two minor flaps C12. The main flaps C11 are connected to the side walls C20 facing in the left-right direction. The minor flaps C12 are connected to the side wall C20*s* facing in the front-rear direction.

As shown in FIG. 4, the box C can be in a first orientation S1 and a second orientation S2. In the first orientation S1, the opening O of the box C faces sideways. More specifically, in the first orientation S1, the opening O faces backward. In the second orientation S2, the opening O of the box C faces upward.

During the boxing operation, the box C is moved sequentially to the box supply position P1, the boxing position P2, and the scaling and sorting position P3. At the box supply position P1, the box C is in the first orientation S1 and moves along the vertical direction. At the boxing position P2 and the scaling and sorting position P3, the box C is in the second orientation S2 and moves in the horizontal direction. The article group B1 is boxed into the opening O. Therefore, during the boxing operation, the flaps C10 need to be open to the outside of the box C until the loading of a predetermined number of article groups B1 is completed.

As shown in FIGS. 2 and 4, the box supply position P1 is located near the center in the front-rear direction of the boxing device 300. At the box supply position P1, a box C is supplied from outside the boxing device 300. More specifically, at the box supply position P1, a box C in the first orientation S1 is supplied from an upper part of the boxing device 300.

The boxing position P2 is located rearward of the box supply position P1. The boxing position P2 is disposed at a lower position than the box supply position P1. At the boxing position P2, the article group B1 is boxed into the box C through the opening O. At the boxing position P2, the box C is in the second orientation S2. Since the opening O of the box C faces upward, the article group B1 is boxed into the box C from above the opening O.

The scaling and sorting position P3 is located forward of the box supply position P1. The scaling and sorting position P3 is located lower than the box supply position P1 and at the same height as the boxing position P2. At the sealing and sorting position P3, the box C is scaled and sorted.

(2) Detailed Configuration (2-1) Box-Moving Section

The box-moving section 10 moves the box C from the box supply position P1 to the boxing position P2. The box-moving section 10 is controlled by the control unit 80.

The box-moving section 10 has a box holder 11, a first cam 12, a second cam 13, a transmission member 13*a*, a first cam rail 14, and a second cam rail 15.

The first cam rail 14 is disposed spanning from the box supply position P1 to the boxing position P2. More specifically, the first cam rail 14 is disposed in a front part of the box supply position P1 of the boxing device 300. The first cam rail 14 includes a vertical part 14*a* extending in the vertical direction, an inclined part 14*b* inclined relative to the vertical direction, and a horizontal part 14*c* extending in the horizontal direction. The vertical part 14*a* extends along the vertical direction from the vicinity of a box loading port at the top of the boxing device 300. The vertical part 14*a* connects to the inclined part 14*b*, and the inclined part 14*b* connects to the horizontal part 14*c*.

The first cam 12 is connected near a suction part of the box holder 11. The first cam 12 is movable along the first cam rail 14 in order of the vertical direction, the direction inclined relative to the vertical direction, and the horizontal direction, and also in the opposite order. A detailed operation of the first cam 12, etc., shall be described in detail in the section on the boxing operation described later.

The second cam rail 15 is disposed at the boxing position P2. More specifically, the second cam rail 15 is disposed below the pushing section 50 so as to extend in the front-rear direction.

The transmission member 13*a* is disposed between the first cam 12 and the second cam 13.

The second cam 13 is connected to the box holder 11 via the transmission member 13*a*. The second cam 13 moves along the second cam rail 15. The second cam 13 is disposed in contact with the second cam rail 15 due to gravity.

The box holder 11 moves the box C. The box holder 11 has a suction part (not shown) in a central portion thereof. The suction part suctions a right side surface of the box C and holds the box C from the side surface. The box holder 11 holds the box C by clamping vertically opposing surfaces of the box C from the outside.

Following the movement of the first cam 12 and the second cam 13, the box holder 11 moves in order in the vertical direction, in the direction inclined relative to the vertical direction, and in the horizontal direction, and moves the box C from the box supply position P1 to the boxing position P2. When the box C is conveyed by the box-transferring section 60, the box holder moves in the horizontal direction, in the direction inclined relative to the vertical direction, and in the vertical direction and returns to the upper part of the box supply position P1.

The box-moving section 10 moves the supplied box C, which is in the first orientation S1, downward along the vertical direction. Before the pushing section 50 pushes the article group B1 into the box C, the box-moving section 10 moves the box C so that the orientation of the box C changes from the first orientation S1 to the second orientation S2. The box-moving section 10 moves the box C from the box supply position P1 to the boxing position P2 while keeping the box C aligned with the flap support section 20 (described hereinafter). When it is moved from the box supply position P1 to the boxing position P2, the box C moves in an arcuate trajectory in a side view.

(2-2) Flap Support Section

The flap support section 20 supports the flaps C10. The flap support section 20 supports the flaps C10 when the orientation of the box C changes from the first orientation S1 to the second orientation S2.

The flap support section 20 includes multiple rod-form members. The attachment location of the flap support section 20 is not particularly limited; for example, the flap support section 20 is attached to the box-moving section 10. The flap support section 20 need not be in constant contact with the flaps C10.

Figure 5:
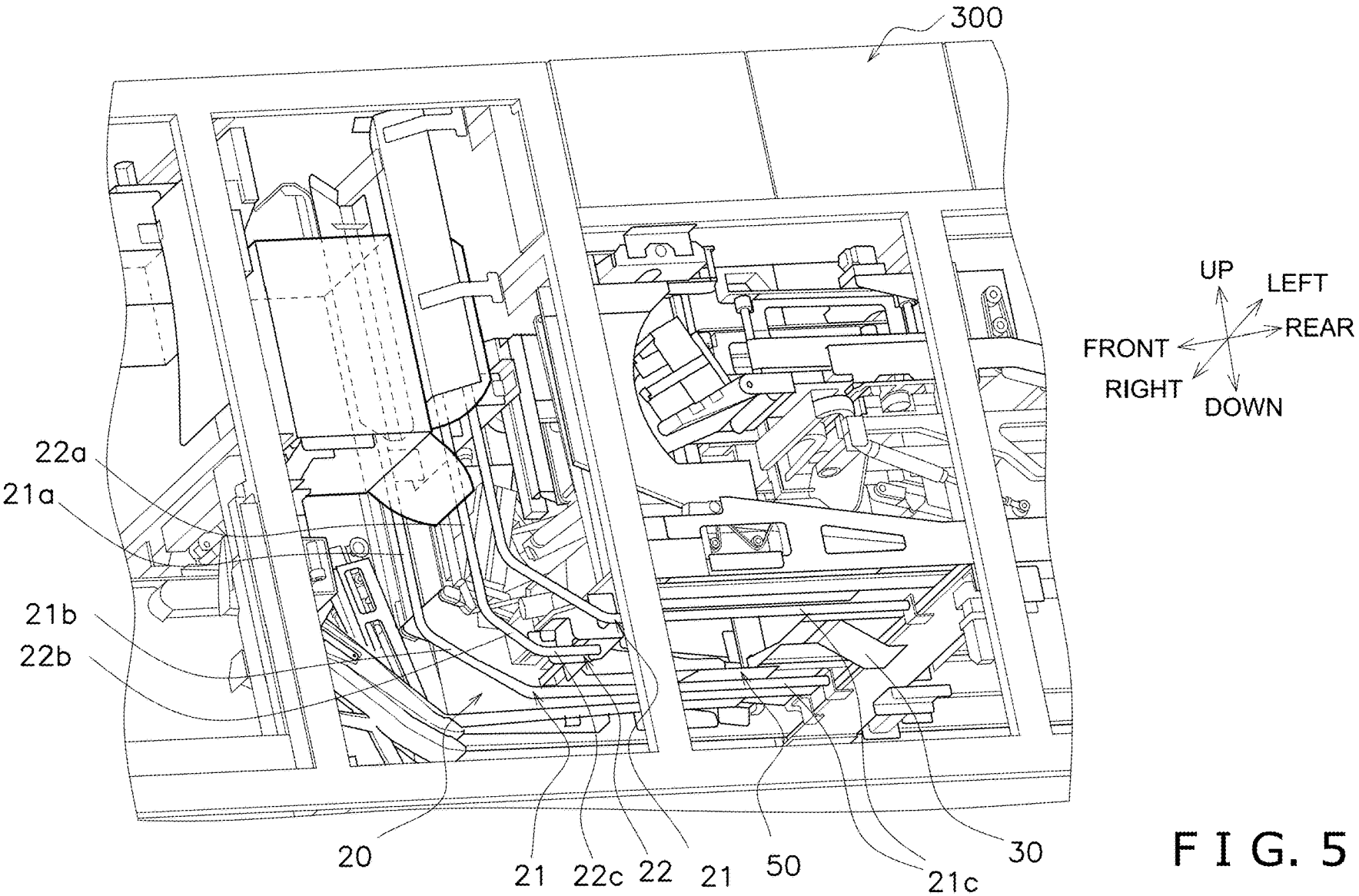
FIG. 5 is a perspective view from below of the boxing device.

In the present embodiment, the flap support section 20 includes three rod-form members, as shown in FIG. 5. More specifically, the flap support section 20 includes two major bars 21 and one sub bar 22.

Each of the two major bars 21 lays down each main flap C11 of the box C to the outside of the box C.

The two major bars 21 have the same shape. The two major bars 21 are disposed parallel to each other. The two major bars 21 are disposed adjacent to each other in the left-right direction with a gap therebetween, in positions where the major bars are in contact with different main flaps C11 of the box C. A width between the major bars 21 is greater than a left-right width of the opening of the box C. This allows the major bars 21 to lay down the main flaps C11 to the outside of the box C.

The major bars 21 each have a first part 21*a*, a second part 21*b*, and a third part 21*c*. The first part 21*a* connects to the second part 21*b*, and the second part 21*b* connects to the third part 21*c*.

The first part 21*a* is disposed in the box supply position P1. The first part 21*a* extends along the vertical direction from the vicinity of the box loading port at the upper part of the boxing device 300.

The second part 21*b* is disposed spanning from the box supply position P1 to the boxing position P2. The second part 21*b* is a radius part extending in an arc from the front to the rear in a side view. Though not particularly limited, the bending R of the second part 21*b* may be R3 or greater (radius: ≥3 mm). In the present embodiment, for example, the bending R of the second part 21*b* may be R100 (radius: 100 mm). The second part 21*b* extends in a direction inclined backward in relation to the vertical direction at the connecting part with the first part 21*a*. The second part 21*b* extends backward so as to approach the horizontal direction at the connecting part with the third part 21*c*.

The third part 21*c* is disposed in the boxing position P2. In a lower part of the pushing section 50, the third part 21*c* extends along the horizontal direction to a rear end of the pushing section 50.

The sub bar 22 lays down a minor flap C12 of the box C to the outside of the box C. In particular, when the box C moves from the box supply position P1 to the boxing position P2, the sub bar 22 lays down the minor flap C12, which is on the rear side in the movement direction of the box C, to the outside of the box C.

The sub bar 22 is disposed between the two major bars 21 so as to be parallel to each of the major bars 21. The sub bar 22 is disposed across a gap from each of the major bars 21. The sub bar 22 is disposed at a position where contact is made with the minor flaps C12 of the box C.

The sub bar 22 has a fourth part 22*a*, a fifth part 22*b*, and a sixth part 22*c*. The fourth part 22*a* connects to the fifth part 22*b*, and the fifth part 22*b* connects to the sixth part 22*c*.

The fourth part 22*a* extends parallel to the first part 21*a* along the vertical direction from the vicinity of the box loading port at the upper part of the boxing device 300. The fourth part 22*a* is disposed to the rear of the first part 21*a* in a side view.

The fifth part 22*b* is a radius part extending in an arc from the front to the rear in a side view. Though not particularly limited, the bending R of the fifth part 22*b* may be R3 or greater (radius: ≥3 mm). In the present embodiment, for example, the bending R of the fifth part 22*b* may be R100 (radius: 100 mm). The bending R of the fifth part 22*b* may be smaller or greater than the bending R of the second part 21*b*. This allows the fifth part 22*b* to easily push the minor flap C12 without obstructing the movement of the box C when the box C changes from the first orientation S1 to the second orientation S2. The fifth part 22*b* extends in a direction inclined backward in relation to the vertical direction at the connecting part with the fourth part 22*a*. The fifth part 22*b* extends backward so as to approach the horizontal direction at the connecting part with the sixth part 22*c*.

The sixth part 22*c* extends parallel to the third part 21*c*, along the horizontal direction up to a front end of the pushing section 50. The sixth part 22*c* is not disposed below the lower part of the pushing section 50. The sixth part 22*c* and the third part 21*c* are of the same height.

(2-3) Second Flap Support Section

The second flap support section 30 is disposed rearward of an opening/closing member 51 so as to face the minor flap C12 on the rear side of the box C. The second flap support section 30 is a plate-form member extending in the front-rear direction. The second flap support section 30 supports the minor flap C12 on the rear side of the box C when the box C is in the boxing position P2.

(2-4) Third Flap Support Section

As shown in FIG. 2, the third flap support section 40 is disposed in front of the boxing device 300, on the outside of the arcuate trajectory of the box C when the box C changes orientation. The third flap support section 40 prevents the flaps C10 of the box C from falling to the inside of the box C when the box C moves from the boxing position P2 to the sealing and sorting position P3. The third flap support section 40 is controlled by the control unit 80.

Figure 6:
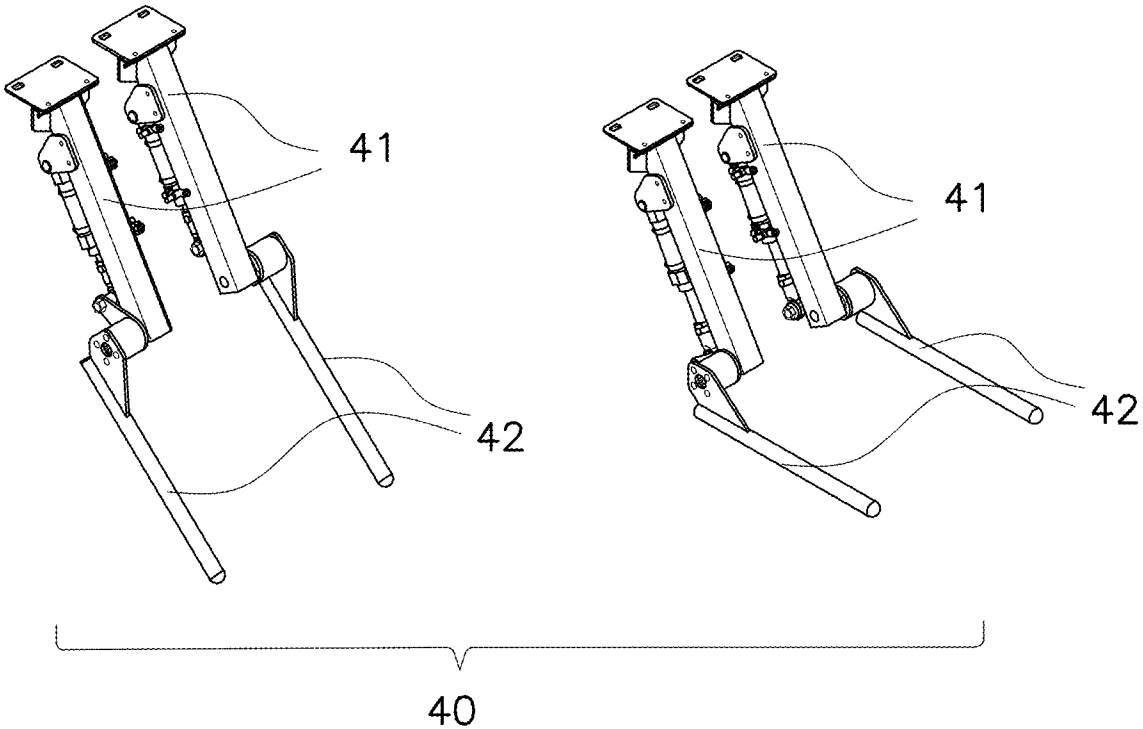
FIG. 6 is a perspective view of a third flap support section.

As shown in FIG. 6, the third flap support part 40 includes two members. Each member includes a fixed part 41 and a movable part 42. The attachment location of the fixed part 41 is not particularly limited; for example, the fixed part 41 is fixed to a lower part of a sealing section 71. The movable part 42 has one end pivotally connected to the fixed part 41, and the one end is disposed to be movable in the up-down direction. The movable part 42 pivots in the up-down direction due to an air cylinder. The two movable parts 42 are arranged parallel to each other with a gap therebetween. A distance between opposing surfaces of the two movable parts 42 is smaller than a length of the opening O of the box C in the left-right direction. Therefore, the minor flaps C12 of the box C can be held down. A distance between left and right outer surfaces of the two movable parts 42 is greater than the length of the opening O of the box C in the left-right direction. Therefore, the main flaps C11 of the box C can be held down.

As shown in the left drawing of FIG. 6, while the box C is moving from the box supply position P1 to the boxing position P2, the ends of the movable parts 42 are lowered downward. As a result, the third flap support part 40 does not block the path along which the box C descends. On the other hand, as shown in the right drawing of FIG. 6, while the box C is moving from the boxing position P2 to the sealing and sorting position P3, the ends of the movable parts 42 rise upward and hold down the flaps C10 of the box C from above. As a result, even if the box C is moved from the boxing position P2 to the sealing and sorting position P3 using part of the path along which the box C descends, the third flap support part 40 does not obstruct the movement of the box C.

(2-5) Pushing Section

The pushing section 50 pushes the article group B1, in which a plurality of articles conveyed by the article-conveying section 201 are aligned side-by-side, into a box C located at the boxing position P2. The pushing section 50 is controlled by the control unit 80.

The pushing section 50 is disposed at a final end of the article-conveying section 201. The pushing section 50 has the opening/closing member 51. The opening/closing member 51 is positioned above the opening O of the box C when the box C is in the boxing position P2.

The opening/closing member 51 is positioned at the final end of the article-conveying section 201 and supports the article group B1 that has been conveyed from the article-conveying section 201 and has been combined. The opening/closing member 51 places the article group B1 into the box C. More specifically, the opening/closing member 51 opens all at once in the left-right direction from a center, and places the article group B1 all together into the box C. The opening/closing member 51 opens to inner dimensions of the box C.

Figure 7:
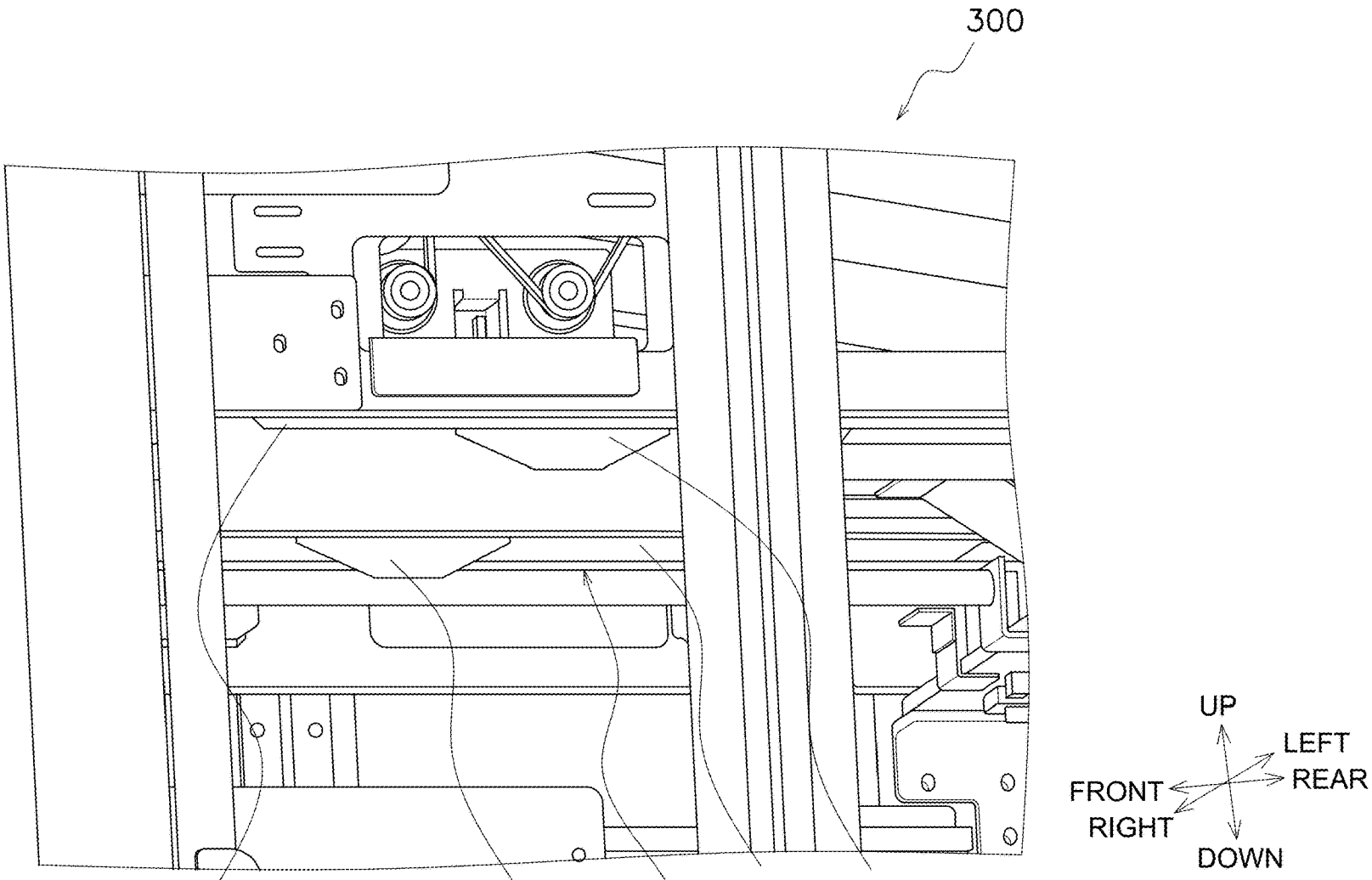
FIG. 7 is a perspective view from below of an opening/closing member.

As shown in FIG. 7, the opening/closing member 51 includes two protrusions 51*a* on a surface that faces the box C. FIG. 7 shows a state in which the opening/closing member 51 is open to the left and right.

The protrusions 51*a* are individually disposed at the end of the center of the opening/closing member 51. The protrusions 51*a* extend in the front-rear direction. The protrusions 51*a* are of such height as to allow contact to be made thereby with upper ends of the side walls C20 of the box C in the boxing position. The protrusions 51*a* move together with the center of the opening/closing member 51, and therefore move to a breadth nearly equal to the inner dimensions of the box C.

The protrusions 51*a* reliably widen the opening O of the box C to the left and right while centering the box C. Front ends of the protrusions 51*a* are inclined backward and downward. Therefore, even if the box C moves in the horizontal direction to be placed in the boxing position P2, the protrusions 51*a* are prevented from getting caught on the flaps C10 of the box C.

(2-6) Box-Transferring Section

The box-transferring section 60 transfers the box C into which the article group B1 has been loaded. The box-transferring section 60 is controlled by the control unit 80. The box-transferring section 60 is driven by a servo motor.

The box-transferring section 60 has a conveying mechanism and a box lifter mechanism (neither is shown).

The conveying mechanism includes a conveyor. The box-transferring section 60, via the conveying mechanism, transfers the box C into which the article group B1 has been boxed. The box-transferring section 60 is disposed at a standby position P4 so as to be movable in the front-rear direction. The standby position P4 is in a front part of the boxing device 300. The standby position P4 is adjacent to the sealing and sorting position P3.

After the box C has been changed to the second orientation S2, the box-transferring section 60 moves from the standby position P4 to the boxing position P2 below the box C. As a result, while the box C is being moved from the boxing position P2 to the scaling and sorting position P3, the next box C can be lowered. Therefore, the time required to replace the box C can be reduced. When the loading of the article group B1 into the box C is completed, the box-transferring section 60 transfers the box C forward. The box-transferring section 60 delivers the box to the second box-transferring section 70.

Figure 8:
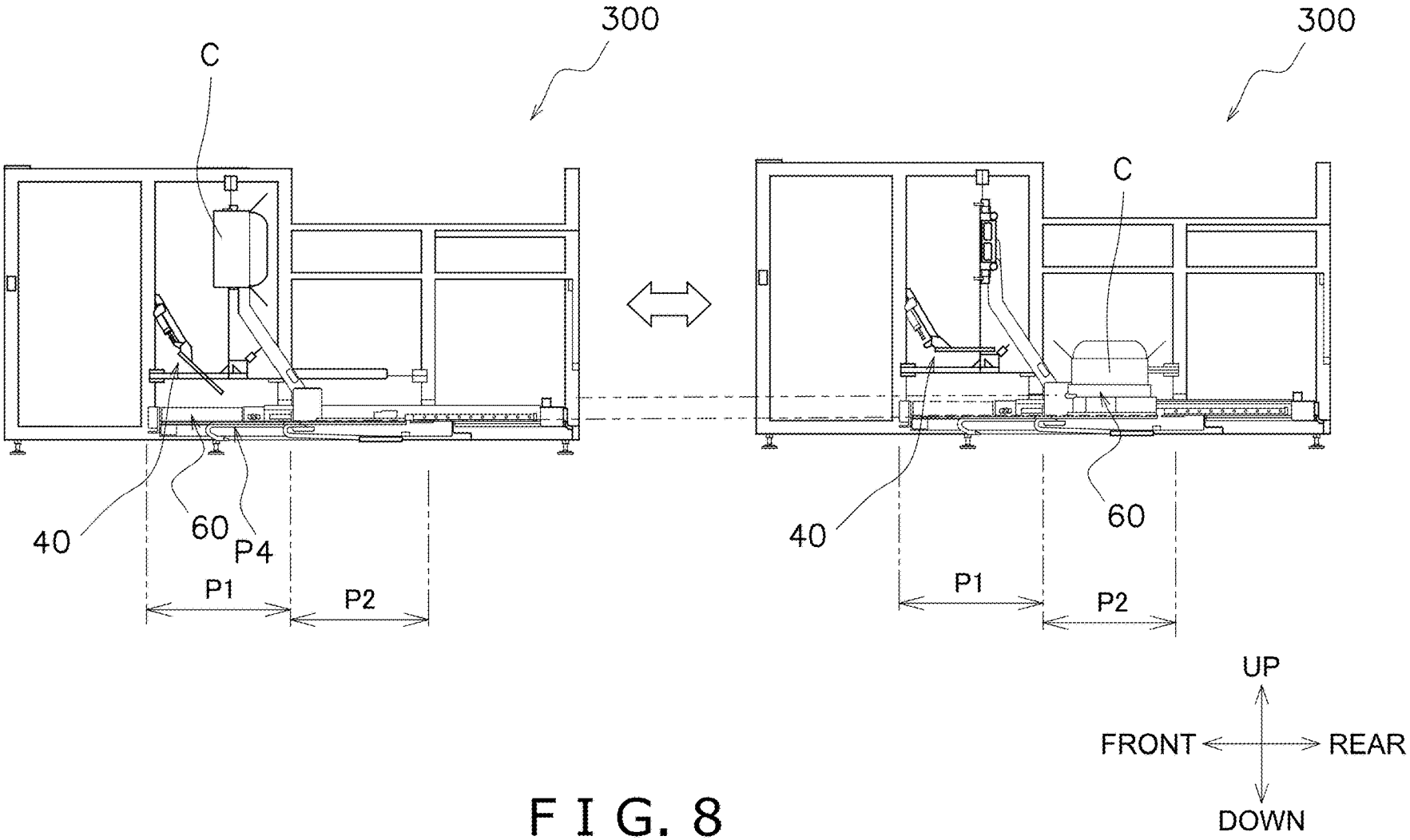
FIG. 8 is a schematic diagram illustrating a change in vertical position of a box-transferring section.

The box lifter mechanism can move up and down according to the height of the box C. As shown in FIG. 8, when the box C is moved to the boxing position P2 and the box-transferring section 60 moves below the box C, the box-transferring section 60 is moved upward by the box lifter mechanism. This causes the flap support section 20 to come into contact with the flaps C10, allowing the flaps C10 reliably to be opened outward. In addition, the box lifter mechanism at low height can handle even a box C at low height. When the loading of the article group B1 into the box C is completed, the box-transferring section 60 is moved downward by the box lifter mechanism.

(2-7) Second Box-Transferring Section

The second box-transferring section 70 seals and sorts the box C transferred by the box-transferring section 60. The second box-transferring section 70 is controlled by the control unit 80.

The second box-transferring section 70 includes the sealing section 71 and a sorting section 72. The sealing section 71 uses the flaps C10 to cover the opening O of the box C and tapes the flaps closed. The sorting section 72 performs classification into acceptable boxes, for which the boxing is regarded as acceptable, and unacceptable boxes, for which the boxing is not regarded as acceptable, and separates and conveys the boxes C out of the boxing device 300. The sorted boxes C are conveyed out from, for example, a front end of the boxing device 300.

The sorting section 72 sorts the boxes into acceptable boxes and unacceptable boxes. There is no particular limitation on the method for determining whether a box is acceptable or unacceptable; for example, the control unit 80 determines whether or not the weight of the box C is within a predetermined range on the basis of an output signal from a load cell. When the weight is determined to be outside of the predetermined range, a failure signal indicating that the weight is determined to be outside of the predetermined range is sent to the sorting section 72. The sorting section 72 sorts unacceptable boxes into an unacceptable-box-collection conveyor (not shown) in accordance with failure signals from the control unit 80.

The sorting section 72 is a conveyor. The conveyor transfers the boxes C in the front-rear direction. The second box-transferring section 70 is disposed in front of the box-transferring section 60. The second box-transferring section 70 is able to rotate. As a result, as soon as a box C can be transferred to the sealing position, the next cycle of boxing can be performed without waiting for sealing to have concluded. In the box-transferring section 60, boxes can be transferred using flap folding surfaces as a reference, making it easier to control the flaps. When the boxes are conveyed out after sealing, conveyor height can be changed using the conveyor height of the next stage as a reference, and the boxes can be conveyed out, increasing the freedom of box transfer. Since the unit that performs sealing and the unit that sorts the boxes C can be disposed in the same position, the section occupied by these units in the boxing device 300 can be shortened.

A mechanical locking mechanism is disposed on a rotating lever that rotates the second box-transferring section 70. The locking mechanism may, for example, be a leaf spring stopper. The second box-transferring section is disposed below the sealing section 71. The second box-transferring section carries out the sorting of the boxes C. If a box C is acceptable, the second box-transferring section moves the box C forward. If a box C is unacceptable, the locking mechanism mechanically locks.

(2-8) Control Unit

Figure 9:
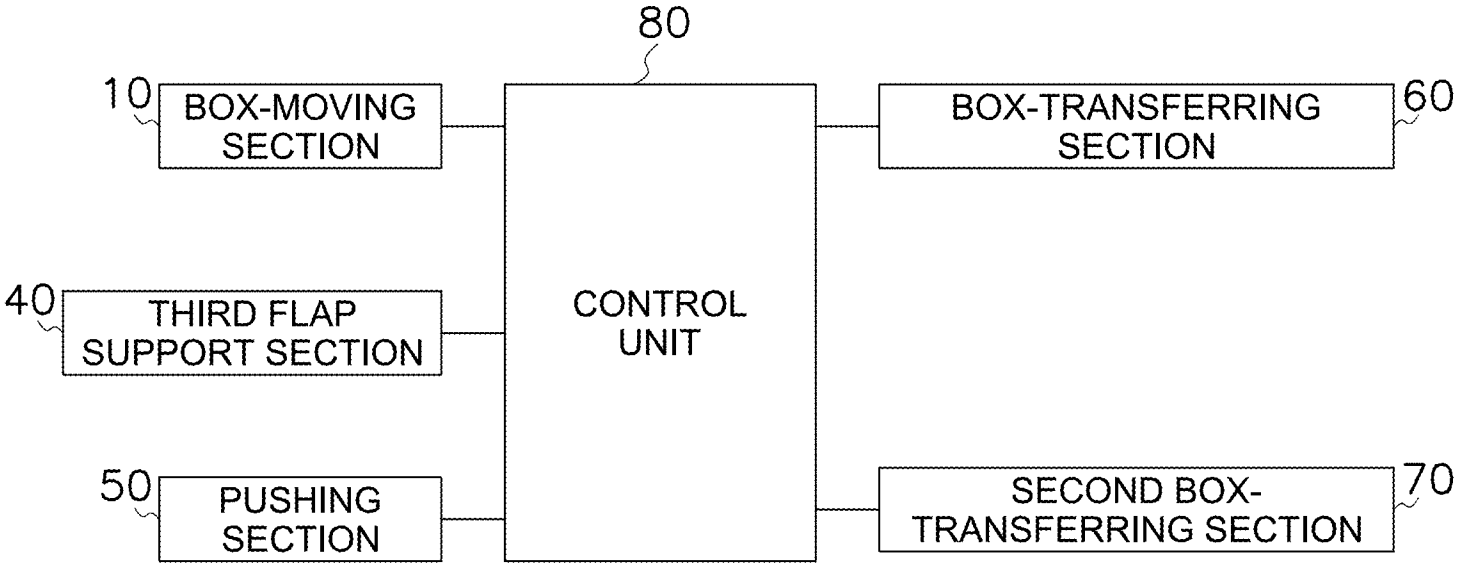
FIG. 9 is a block diagram of a control unit.

The control unit 80 controls the parts of the boxing device 300 to implement the boxing operation. The boxing operation includes a box-moving process, a boxing process, a box-transferring process, and a sealing and sorting process. The details of the boxing operation shall be described later. FIG. 9 is a block diagram of the control unit 80. The control unit 80 is electrically connected to the box-moving section 10, the third flap support section 40, the pushing section 50, the box-transferring section 60, and the second box-transferring section 70 so as to be able to transmit and receive control signals and detection signals.

The control unit 80 is implemented by a computer. The control unit 80 includes a control arithmetic device and a storage device. A processor such as a CPU or a GPU can be used as the control arithmetic device. The control arithmetic device reads a program stored in the storage device and performs a predetermined arithmetic process in accordance with the program. Furthermore, the control arithmetic device can write an arithmetic result to the storage device and read information stored in the storage device in accordance with the program.

(3) Boxing Operation

The boxing operation is an operation of repeatedly boxing a predetermined number N of articles B into a box C. The boxing operation includes a box-moving process, a boxing process, a box-transferring process, and a sealing and sorting process. The boxing operation is started, for example, when a packaging and boxing line (not shown) activates.

When the boxing operation is started, the control unit 80 starts the box-moving process. The box-moving process is a process of moving the box C from the box supply position P1 to the boxing position P2.

In the box-moving process, a box C is supplied from the outside of the boxing device 300 at the box supply position P1. The control unit 80 controls the box-moving section 10 to move the box C. More specifically, at the box supply position P1, the box holder 11 suctions side surfaces of the supplied box C to hold the box C from the side surfaces and top and bottom surfaces, and holds a first orientation of the box C. At this time, as shown in FIG. 2, the first cam 12 is located at the vertical part 14*a* of the first cam rail, and the second cam 13 is located at the second cam rail 15. The first cam 12 moves downward along the vertical part 14*a*, and the second cam 13 moves backward along the second cam rail 15. Following the movements of the first cam 12 and the second cam 13, the box holder 11 moves downward while holding the box C.

Figure 10:
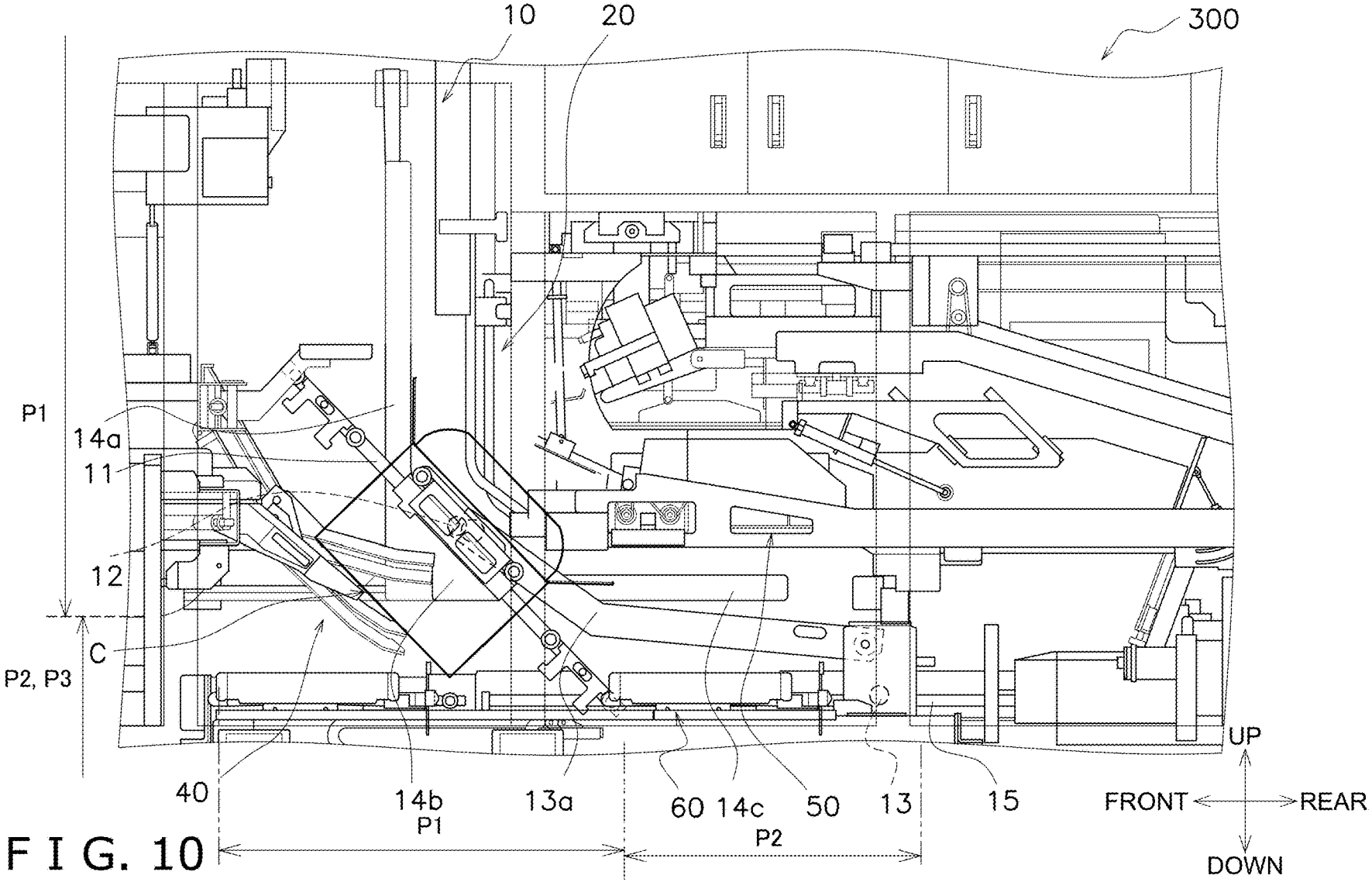
FIG. 10 is a side view illustrating movement of the box and a box-moving section.

Next, as shown in FIG. 10, before the pushing section 50 pushes the article group B1 into the box C, the first cam 12 moves to the inclined part 14*b* of the first cam rail, and the second cam 13 moves further backward along the second cam rail 15. The box holder 11, while still holding the box C, becomes inclined in relation to the vertical direction.

Figure 11:
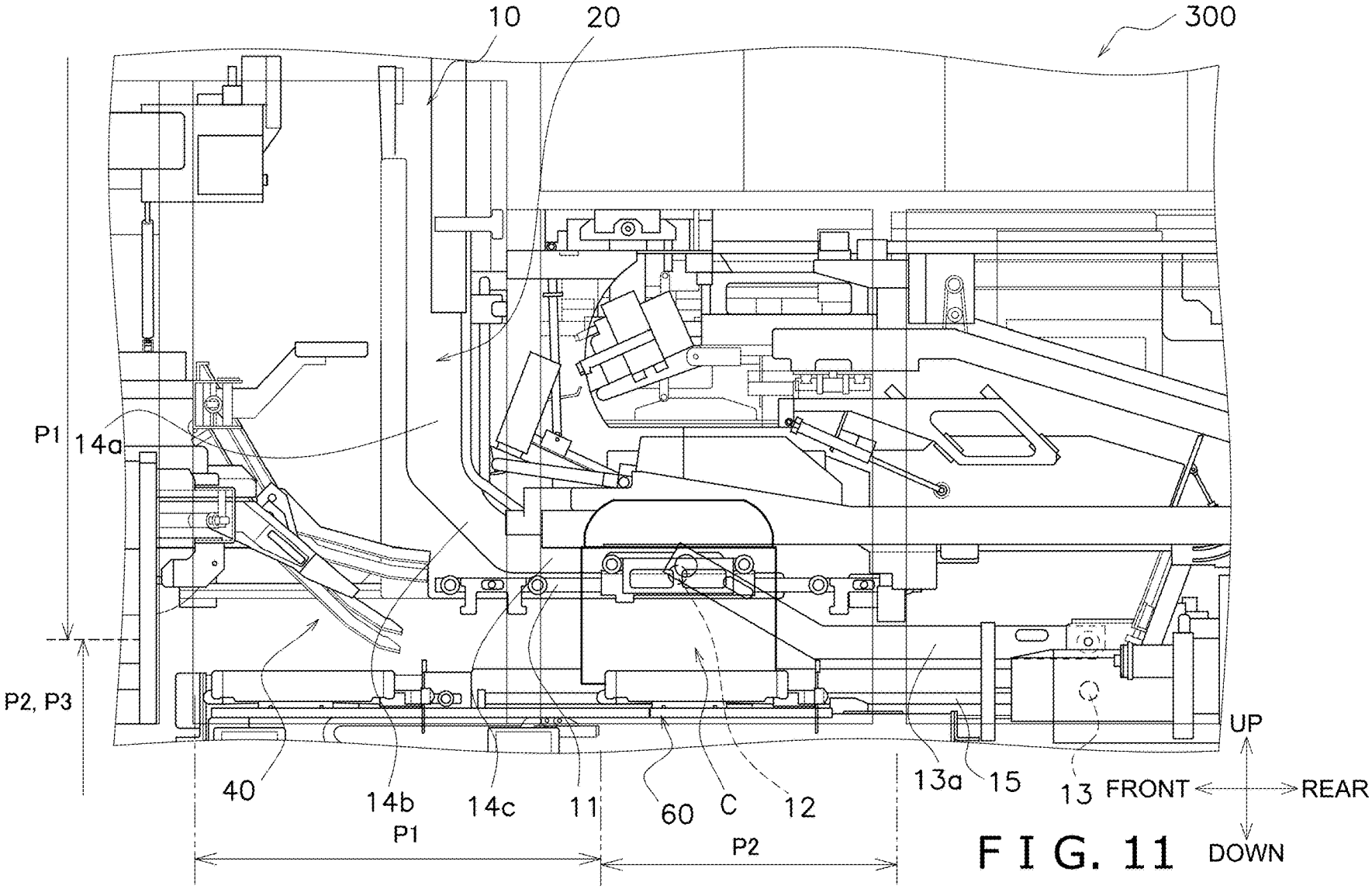
FIG. 11 is a side view illustrating movement of the box and the box-moving section.

Next, as shown in FIG. 11, the first cam 12 moves to the horizontal part 14*c* of the first cam rail, and the second cam 13 moves further backward along the second cam rail 15. The box holder 11, while still holding the box C, becomes extended in the horizontal direction. The orientation of the box C is thereby changed from the first orientation S1 to the second orientation S2. The first cam 12 moves backward along the horizontal part 14*c*, and the second cam 13 moves further backward along the second cam rail 15. The box holder 11, following the movements of the first cam 12 and the second cam 13, moves the box C in the second orientation S2 to the boxing position P2.

While the box C is being moved from the box supply position P1 to the boxing position P2, the flap support section 20 is always in a state of being able to be in contact with the flaps C10 of the box C. Therefore, the flaps C10 of the box C are reliably maintained in an open state toward the outside of the box C. When being moved from the box supply position P1 to the boxing position P2, the box C moves in an arcuate trajectory in a side view.

While the box C is in the box supply position P1, the box-transferring section 60 waits at the standby position P4. At the same time that the box C moves to the boxing position P2, the control unit 80 moves the box-transferring section 60 below the box C. The box-transferring section 60, upon arriving at the boxing position P2, moves upward due to the box lifter mechanism and raises the box C to the desired height for boxing. As a consequence thereof, the flaps C10 of the box C come into contact with the flap support section 20 and the second flap support section 30, and the flaps C10 of the box C reliably open to the outside of the box C.

When the box C arrives at the boxing position P2, the control unit 80 starts the boxing process. The boxing process is a process of packing the article group B1 into the opening O of the box C.

The control unit 80 controls the pushing section 50 and the opening/closing member 51 of the pushing section 50 opens left and right from the center. The pushing section 50 thereby loads the article group B1 into the box C. When the opening/closing member 51 opens left and right, the protrusions 51*a* also move left and right. The protrusions 51*a* thereby reliably widen the opening O of the box C to the left and right.

When loading of the article group B1 is completed, the control unit 80 starts the box-transferring process. The box-transferring process is a process of conveying out the box C into which the article group B1 is packed.

The box-transferring section 60 is controlled by the control unit 80 and moved downward so that the height of the box C is put at a desired discharge height by the box lifter mechanism. The desired discharge height may, for example, be the height at which the box C is discharged. The box-transferring section 60 moves horizontally forward, which is the box discharge direction, while still carrying the box C, and moves to the standby position P4. Upon arriving at the standby position P4, the box-transferring section 60 delivers the box C to the second box-transferring section 70. At the same time that the box-transferring section 60 finishes moving forward, the next box C2 is conveyed in. At the same time that the next box C2 becomes horizontal, the box-transferring section 60 passes under the box C2 and moves below the box C2. The box-transferring section 60 moves upward due to the box lifter mechanism and raises the box C2 to the desired position for boxing.

When the box C arrives at the sealing and sorting position P3, the control unit 80 starts the sealing and sorting process. Sealing and sorting is the process of closing the flaps C10 of boxes C, applying tape, and sorting the boxes into acceptable boxes and unacceptable boxes.

The second box-transferring section 70 performs the sealing of boxes C. The second box-transferring section 70 sorts the boxes C that have finished being sealed and conveys the boxes C out of the boxing device 300.

(4) Characteristics (4-1)

A boxing device 300 of the disclosed, exemplary embodiment of the claimed invention has a box-moving section 10, a flap support section 20, and a pushing section 50. The box-moving section 10 moves a box C from a box supply position P1 to a boxing position P2. The box C has flaps C10. The flaps C10 are disposed continuously with respect to side walls C20 that define an opening O. At the box supply position P1, the box C is supplied from the outside. At the boxing position P2, a plurality of articles B are boxed in the opening O. The flap support section 20 supports the flaps C10. A pushing section 50 pushes an article group B1, in which a plurality of the articles B conveyed by an article-conveying section 201 are aligned side-by-side, into the box in the boxing position P2. The box-moving section 10, before the pushing section 50 pushes the article group B1 into the box C, moves the box C so that the box C changes in orientation from a first orientation S1, in which the opening O of the box C faces sideways in the box supply position P1, to a second orientation S2, in which the opening O of the box C faces upwards in the boxing position P2. The flap support section 20 supports the flaps C10 when the orientation of the box C changes from the first orientation S1 to the second orientation S2.

In the boxing device 300 of the present embodiment, the flaps C10 of the box C can be prevented from falling inward.

(4-2)

In the boxing device 300 of the present embodiment, the flap support section 20 has a first part 21*a*, a second part 21*b*, and a third part 21*c*. The first part 21*a* extends along a vertical direction. The second part 21*b* extends in a direction inclined in relation to the vertical direction. The third part 21*c* extends along a horizontal direction.

In the boxing device 300 of the present embodiment, the flaps C10 of the box C can be prevented from falling inward while the box C is moving from the box supply position P1 to the boxing position P2.

(4-3)

In the boxing device 300 of the present embodiment, the box-moving section 10 moves the box C from the box supply position P1 to the boxing position P2 while keeping the box aligned with the flap support section 20.

In the boxing device 300 of the present embodiment, the flap support section 20 can support the flaps C10 in accordance with a trajectory in which the box C moves.

(4-4)

In the boxing device 300 of the present embodiment, the pushing section 50 has an opening/closing member 51. The opening/closing member 51 includes protrusions 51*a* on a surface that faces the box C.

Since the protrusions 51*a* open the box C to the left and right, a separate member is not required for accurate centering of the box C. In addition, the protrusions 51*a* allow the opening/closing member to be opened to a breadth nearly equal to the inner dimensions of the box C, thereby increasing the allowance for boxing. Furthermore, even if a recycled box is used, the protrusions 51*a* forcibly open the box C to predetermined inner dimensions, thereby suppressing the incidence of defects in the articles B, etc.

(4-5)

The boxing device 300 of the present embodiment further has a box-transferring section 60. The box-transferring section 60 transfers the box C in which the article group B1 is boxed. The box-transferring section 60 moves from a standby position P4 to below the box C after the box C has been changed to the second orientation S2.

Since the next box C2 can be lowered while the box-transferring section 60 is moving in the front-rear direction, the time required for replacing the box C can be shortened.

(4-6)

In the boxing device 300 of the present embodiment, the flap support section 20 lays down a minor flap C12 that is on a rear side of the box C in a box movement direction to the outside of the box C when the box C moves from the box supply position P1 to the boxing position P2.

In the boxing device 300 of the present embodiment, the minor flap C12 that is on the rear side of the box C in the box movement direction can be prevented from falling inward while the box C is moving from the box supply position P1 to the boxing position P2.

(5) Modifications (5-1) Modification A

In the above embodiment, in the flap support section 20 of the boxing device 300, the second part 21*b* extends in a direction inclined rearward in relation to the vertical direction at the part of connection with the first part 21*a*, but this example is not given by way of any particular limitation. The second part 21*b* may extend in a direction inclined forward in relation to the vertical direction at the part of connection with the first part 21*a*. That is, the second part 21*b* may have a shape that bulges forward to describe a partial circle in a side view.

In the present modification, when the box C changes from the first orientation S1 to the second orientation S2, the trajectory of the box C in a side view bulges outward slightly. That is, the trajectory of the box C has a shape that bulges forward to describe a partial circle in a side view. If the second part 21*b* has a shape that bulges forward to describe an arc in a side view, the second part 21*b* can come into contact with the flaps C10 even when the box C changes from the first orientation to the second orientation, and the flaps can be supported more reliably.

(5-2) Modification B

In the above embodiment, the flap support section 20 has three bars, but this example is not given by way of any particular limitation. For example, the flap support section 20 may have two main bars and two sub bars for a total of four bars.

(5-3) Modification C

In the above embodiment, the box holder 11 is disposed only on the right side of the boxing device 300, but this example is not given by way of any particular limitation. The box holder 11 may be disposed on both the left and right sides of the boxing device 300.

(5-4) Modification D

In the above embodiment, the pushing section 50 loads the article group B1 into the box C, but this example is not given by way of any particular limitation. The pushing section 50 may load the articles B into the box C individually.

(5-5) Modification E

In the above embodiment, a box C in the first orientation S1 is supplied from the upper part of the boxing device 300 and conveyed out from the sealing and sorting position P3, but this example is not given by way of any particular limitation. The box C may be supplied from the boxing position P2 or the sealing and sorting position P3. The box C may be conveyed out from the boxing position P2.

REFERENCE SIGNS LIST

10 Box-moving section
20 Flap support section

21*a* First part
21*b* Second part
21*c* Third part
30 Second flap support section
40 Third flap support section
50 Pushing section
51 Opening/closing member
51*a* Protrusion
60 Box-transferring section
201 Article-conveying section
B Articles
B1 Article group
C Box
C10 Flap
C20 Side wall
O Opening
P1 Box supply position
P2 Boxing position
S1 First orientation
S2 Second orientation

CITATION LIST

Patent Literature

[Patent Literature 1] Japanese Laid-open Patent Publication No. 2014-61904

I claim:

1. A boxing device, comprising:

a box-moving section configured to move a box from a box supply position to a boxing position, the box having flaps, each flap being disposed continuously with respect to a side wall defining an opening, the box supply position to which the box is supplied from outside of the boxing device, the boxing position at which a plurality of articles are boxed into the opening;

a flap support section configured to support the flaps; and a pushing section configured to push an article group, in which a plurality of the articles conveyed by an article-conveying section are aligned side-by-side, into the box in the boxing position, the box-moving section, before the pushing section pushes the article group into the box, is configured to move the box so that the box changes in orientation from a first orientation, in which the opening of the box faces sideways in the box supply position, to a second orientation, in which the opening of the box faces upwards in the boxing position, and the flap support section configured to support the flaps when the orientation of the box changes from the first orientation to the second orientation.

2. The boxing device according to claim 1, wherein the flap support section has a first part extending along a vertical direction, a second part extending in a direction inclined in relation to the vertical direction, and a third part extending along a horizontal direction.

3. The boxing device according to claim 1, wherein the box-moving section moves the box from the box supply position to the boxing position while keeping the box aligned with the flap support section.

4. The boxing device according to claim 1, wherein the pushing section has an opening/closing member, and the opening/closing member includes a protrusion on a surface that faces the box.

5. The boxing device according to claim 1, further including a box-transferring section that transfers the box in which the article group is boxed, the box-transferring section moving from a standby position to below the box after the box has been changed to the second orientation.

6. The boxing device according to claim 1, wherein the flap support section lays down the flap that is on a rear side of the box in a box movement direction to the outside of the box when the box moves from the box supply position to the boxing position.

* * * * *